US009532922B2

(12) United States Patent
Rolle et al.

(10) Patent No.: US 9,532,922 B2
(45) Date of Patent: Jan. 3, 2017

(54) BOWEL EVACUATION AID

(71) Applicant: TurDle Time, LLC, Ventura, CA (US)

(72) Inventors: Reno Rolle, Ojai, CA (US); Todd Wiseman, Ventura, CA (US)

(73) Assignee: TURDLE TIME, LLC, Ventura, CA (US)

( * ) Notice: Subject to any disclaimer, the term of this patent is extended or adjusted under 35 U.S.C. 154(b) by 557 days.

(21) Appl. No.: 13/970,979

(22) Filed: Aug. 20, 2013

(65) Prior Publication Data

US 2014/0076330 A1 Mar. 20, 2014

Related U.S. Application Data

(60) Provisional application No. 61/702,349, filed on Sep. 18, 2012.

(51) Int. Cl.

| | |
|---|---|
| ***A61G 13/12*** | (2006.01) |
| ***A61H 21/00*** | (2006.01) |
| ***A61H 15/00*** | (2006.01) |

(52) U.S. Cl.

CPC ..... *A61H 21/00* (2013.01); *A61H 15/0092* (2013.01); *A61H 2015/0014* (2013.01); *A61H 2201/0157* (2013.01); *A61H 2201/1253* (2013.01); *A61H 2201/1628* (2013.01); *A61H 2205/083* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,924,856 | A | 12/1975 | Dekan et al. | |
| 4,891,847 | A * | 1/1990 | Baker | A61F 5/00 128/118.1 |
| 5,388,825 | A | 2/1995 | Myers et al. | |
| 6,148,448 | A * | 11/2000 | Urso | A47K 17/026 297/423.44 |
| 6,795,990 | B1 | 9/2004 | Hutchinson | |
| 2004/0260216 | A1 * | 12/2004 | Zicherman | A61H 23/0254 601/111 |

FOREIGN PATENT DOCUMENTS

WO PCT/US2013/055703 11/2013

OTHER PUBLICATIONS

"Constipation and How to Avoid It", retrieved from http://www.alsindependence.com/Constipation_and_How_to_Avoid_It.htm on Mar. 4, 2015.
EP 13839493 Search Report, issued Sep. 8, 2015.

* cited by examiner

*Primary Examiner* — Ophelia A Hawthorne
(74) *Attorney, Agent, or Firm* — One LLP

(57) ABSTRACT

A device and method that simulates the squatting position for bowel elimination while still sitting on a toilet.

5 Claims, 2 Drawing Sheets

BOWEL EVACUATION AID

REFERENCE TO PRIOR APPLICATION

This application claims priority of the provisional patent application 61/702,349, filed Sep. 18, 2012 entitled BOWEL EVACUATION AID by Reno Rolle and Todd Wiseman.

BACKGROUND OF THE INVENTION

Field of the Invention

The field of this invention relates generally to the field of the elimination of human waste and more particularly toward a device that stimulates the colon for more efficient bowel movements.

Description of the Prior Art

Humans are designed to squat while evacuating the bowel. While squatting, the thighs come in contact with the abdominal wall placing beneficial pressure on the colon. This pressure helps to gently move waste through and out of the colon. The standard toilet is arguably the worst invention in the history of the modern man. While seated on the toilet, the body is upright and in the incorrect anatomical position for ease and efficiency during bowel evacuation. Without the support and beneficial pressure of the thighs contacting the abdominal wall, people are left to push and strain leading to a plethora of health related problems, i.e., hemorrhoids, constipation, etc.

It is the object of the instant invention to provide a means of simulating the more natural squatting pressure for bowel elimination while still using toilets and modern plumbing for the elimination of said waste.

SUMMARY OF THE INVENTION

The basic embodiment of the present invention teaches a device for the aid in the elimination of the bowels comprising: an elongated body; a first end; and a second end wherein said elongated body is connected to said first end and said second end is the same shape as said first end and said second end.

The above embodiment can be further modified by defining that said first and second ends are half moon shaped.

The above embodiment can be further modified by defining that said first and second ends are circular shaped.

The above embodiment can be further modified by defining that said first and second ends are square shaped.

The above embodiment can be further modified by defining that said device is made of foam.

The above embodiment can be further modified by defining that said device is made of wood.

The above embodiment can be further modified by defining that said device is made of plastic.

The above embodiment can be further modified by defining that said device is made of metal.

A second embodiment teaches a method to aid in the elimination of the bowels comprising the steps of: acquiring a device to simulate the pressure of squatting during elimination said device further comprising: an elongated body; a first end; and a second end wherein said elongated body is connected to said first end and said second end is the same shape as said first end and said second end; sitting on a toilet; allowing for the placement of said device against the user's lower abdomen; applying pressure from said device to the user's colon; and moving the bowels.

The above embodiment can be further modified by defining that said first and second ends are half moon shaped.

The above embodiment can be further modified by defining that said first and second ends are circular shaped.

The above embodiment can be further modified by defining that said first and second ends are square shaped.

The above embodiment can be further modified by defining that said device is made of foam.

The above embodiment can be further modified by defining that said device is made of wood.

The above embodiment can be further modified by defining that said device is made of plastic.

The above embodiment can be further modified by defining that said device is made of metal.

The above embodiment can be further modified by defining that said device is spherical and does not have an elongated body connecting a first end and a second end but that can be applied directly to the abdomen as needed.

A third embodiment teaches a device that is a sphere with an outer surface and inner portion that it is filled with firm yet pliable material or materials.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
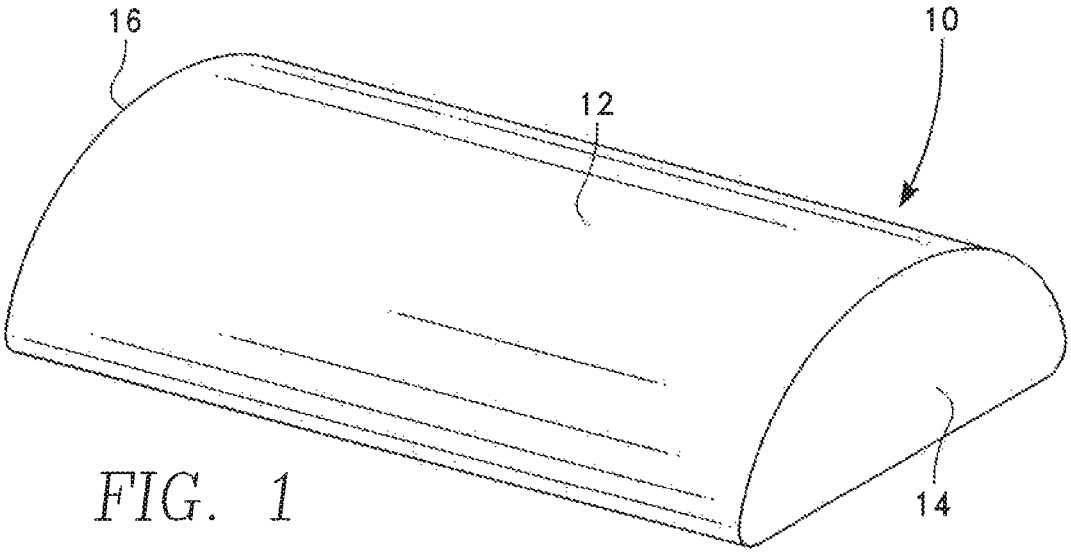
FIG. 1 is a top perspective view of the device of the instant invention.

Turning to the drawings, the preferred embodiment is illustrated and described by reference characters that denote similar elements throughout the several views of the instant invention.

Figure 2A:
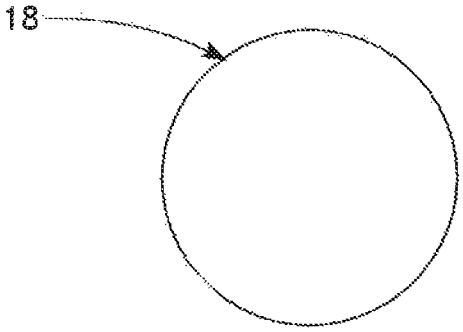
FIG. 2A is a side view of one embodiment of the instant invention.
Figure 2B:
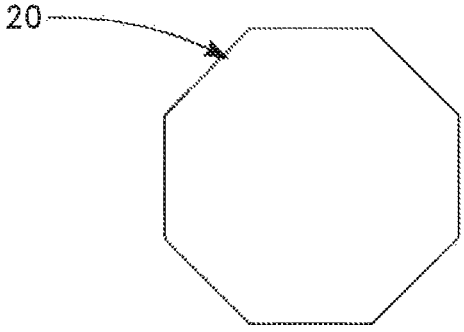
FIG. 2B is a side view of a second embodiment of the instant invention.
Figure 2C:
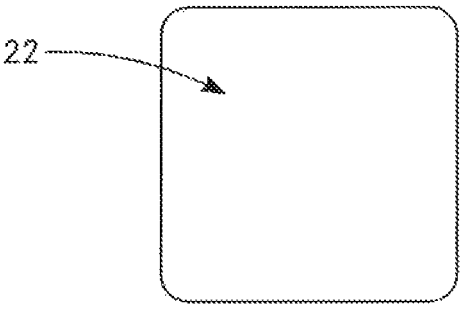
FIG. 2C is a side view of a third embodiment of the instant invention.
Figure 2D:
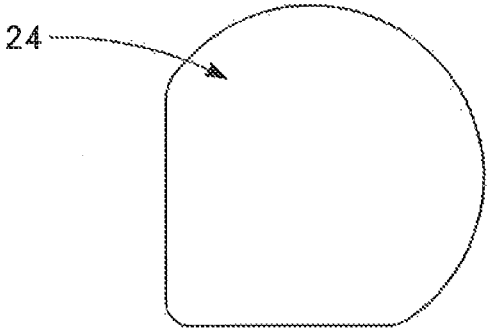
FIG. 2D is a side view of a fourth embodiment of the instant invention.

The preferred embodiment is a foam block 10 with a side shape that is substantially half-moon shaped. However, this shape is not essential as the block 10 could have any number of shapes as illustrated in FIGS. 2A-2B. The block essentially has an elongated body 12 that terminates in two ends 14, 16 of the same shape.

The preferred embodiment has the shape of the ends 14, 16 being a half-moon, but as seen in FIGS. 2A-2B, the shape could also be circular 18, hexagonal 20, square 22 or any odd shape 24 that would aid in the function of the device 10.

It is constructed essentially of half of a 6" round foam roller. It could be configured of different materials and shapes, however. What is important is the function it serves.

The device 10 is used to first gently massage the colon 26 through the application of gentle pressure 28 against the lower abdomen 30, thereby stimulating blood flow. The device 10 is placed in the lap 32 of the user 34. The user 34 then leans forward to bring the lower abdomen 30 in contact with the device 10 which sits in the user's 34 lap 32.

Figure 4:
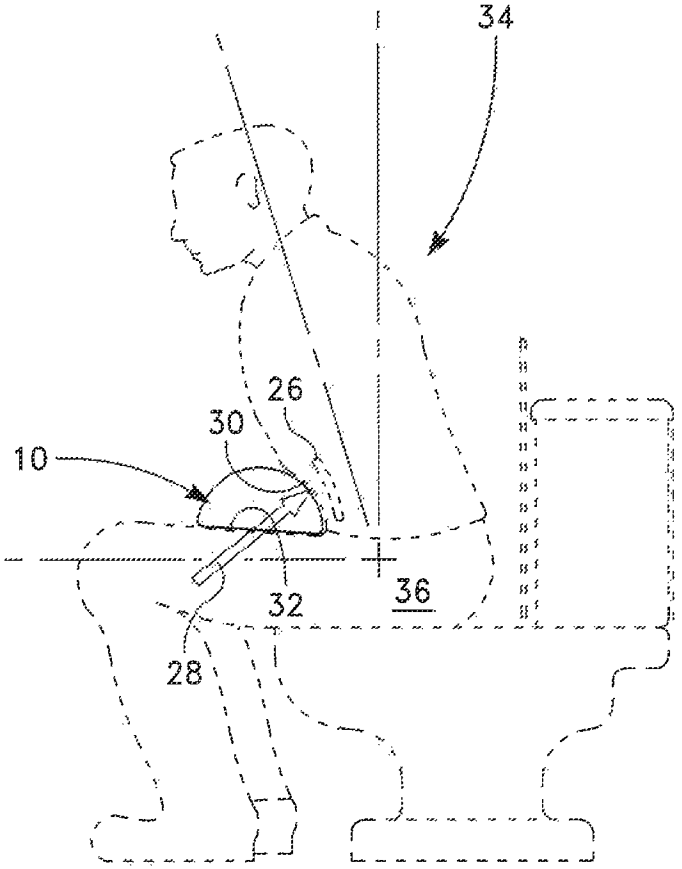
FIG. 4 is a side view of a person sitting on a toilet while using the device of the instant invention.
Figure 3:
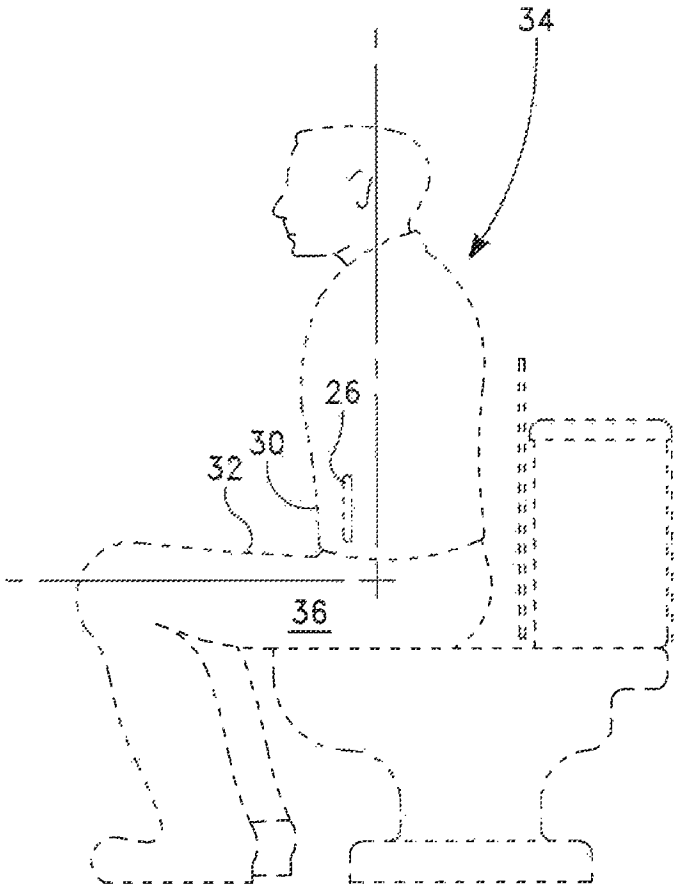
FIG. 3 is a side view of a person sitting on a toilet without the use of the device of the instant invention.

Pressure can be adjusted against the lower abdomen 30 with more direct pressure to specific points in a variety of positions. The device 10 is gently but firmly pressed against the colon 26 while the user 34 leans forward to replicate the squatting position (See FIG. 4) or merely applies pressure to the lower abdomen without leaning over using the device. The gentle pressure the device 10 provides against the colon 26 replaces that of the thighs 36 in the natural squatting position and helps to move the waste down and out. It is analogous to squeezing a tube of toothpaste. It's simple yet incredibly efficacious. For the embodiment of the device that is elongated and how two ends, either the elongated body or either of the two ends can be used to apply the pressure as needed and desired. The device is compact, stand-alone and easily transported with other personal effects so that relief is available wherever the person is.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation, of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A method to aid in the elimination of the bowels comprising the steps of:

acquiring a device to simulate the pressure of squatting during elimination, said device further comprising:

a portable, handheld body, of a size that fits on a user's lap, wherein the body is elongated with a surface that defines a plurality of different shapes that define different pressure points that, when applied to the user's abdomen, may facilitate a bowel movement;

sitting on a toilet;

placing one of said plurality of pressure points of said device against the user's lower abdomen;

applying pressure from the one of said plurality of pressure points of said device to the user's colon; and moving the bowels.

2. The method as defined in claim 1, wherein said device is made of foam.

3. The method as defined in claim 1, wherein said device is made of plastic.

4. The method as defined in claim 1, wherein one of the plurality of different shapes is a half-moon shape with a flat surface.

5. The method as defined in claim 1, wherein one of the plurality of different shapes is curved.

* * * * *